United States Patent [19]

Tooka et al.

[11] Patent Number: 4,542,560

[45] Date of Patent: Sep. 24, 1985

[54] PRE-OPENING DEVICE FOR A CARDING MACHINE

[75] Inventors: Takuzo Tooka, Toyoake; Choji Nozaki, Nagoya; Junzo Hasegawa, Oobu; Susumu Kawabata, Aichi; Hiroshi Niimi, Nagoya; Yoshiaki Yamaoka, Kariya; Hiroaki Goto, Oobu; Yasuhiro Miura, Kariya, all of Japan

[73] Assignee: Kabushiki Kaisha Toyoda Jidoshokki Seisakusho, Kariya, Japan

[21] Appl. No.: 599,256

[22] Filed: Apr. 11, 1984

[30] Foreign Application Priority Data

Apr. 21, 1983 [JP] Japan ..... 58-70683

[51] Int. Cl.[4] ..... D01G 19/32

[52] U.S. Cl. ..... 19/98; 19/104; 19/105; 19/107

[58] Field of Search ..... 19/98, 102, 104, 105, 19/107, 110, 111

[56] References Cited

U.S. PATENT DOCUMENTS

| | | | |
|---|---|---|---|
| 1,658,714 | 2/1928 | Gecauff et al. | 19/98 |
| 3,120,030 | 2/1964 | Reiterer | 19/105 |
| 3,402,432 | 9/1968 | Kalwaites | 19/104 |
| 3,537,144 | 11/1970 | King | 19/107 |
| 4,400,853 | 8/1983 | Loffler | 19/107 |
| 4,438,549 | 3/1984 | Silander | 19/107 |

FOREIGN PATENT DOCUMENTS

| | | | |
|---|---|---|---|
| 832803 | 4/1960 | United Kingdom | 19/105 |
| 1384247 | 2/1975 | United Kingdom | 19/104 |

*Primary Examiner*—Louis K. Rimrodt

*Attorney, Agent, or Firm*—Brooks Haidt Haffner & Delahunty

[57] ABSTRACT

In the present invention, a plurality of fixed flats are disposed in juxtaposition to one another, and an opening 5 to 33 mm wide is formed between each pair of adjoining fixed flats, in such a manner that the dust is entrained in the discharge air current produced at the upstream side of the opening and extracted out of the opened fiber mass.

9 Claims, 10 Drawing Figures

PRE-OPENING DEVICE FOR A CARDING MACHINE

BACKGROUND OF THE INVENTION

This invention relates to a pre-opening device for a carding machine serving to open a fiber mass into individual fibers.

DESCRIPTION OF THE PRIOR ART

A carding machine is essentially composed of a dish plate 1, feed roll 2, taker-in roll 3, cylinder 4, rotating flat 5, a doffer 6 and a doffing member 7, as shown in FIG. 1. The operation of the carding machine is hereafter described by referring to FIG. 1. A layer or lap of fibers (not shown) formed by stacking a fiber mass of natural or synthetic fibers to a predetermined thickness and width is supplied to the feed roll 2, nipped between dish plate 1 and feed roll 2 and supplied to the taker-in toll 3 by rotation of the feed roll 2. Since the taker-in roll 3 is rotating at a higher speed than the feed roll 2 and a metallic wire is placed around the taker-in roll 3, the lap is subjected to combing and the fiber lumps are opened before the lap is delivered to the cylinder 4. When natural fiber cotton is used, there are contained in the lap impurities or dust such as seed coats (called seed trash) or leaves (called leaf trash) besides cotton fibers. Thus the function of the taker-in roll is to open the fiber lumps contained in the lap, to reduce the size of the lumps and to separate the fiber lumps into individual fibers (pre-opening) as well as extracting seed and leaf trash or useless short fibers contained in the fiber mass (dust extraction). The fibers taken over by the cylinder 4 are acted upon by the rotating flat 5, while being securely held by the metallic wires placed around the cylinder 4. In this manner, seed trash or leaf trash as well as short fibers which have escaped the action of the taker-in roll are removed. The fiber mass thus cleaned of impurities and separated into individual fibers is transferred to the doffer 6 where it is again formed into a fiber web and picked off from the doffer by the doffing unit 7. In this type of carding machine, the quantity of cotton passing through various components of the carding machine is increased with an increase in the throughput. The result is the insufficient operation of the taker-in roll 3 on the fiber, increase in the size of the fiber lumps and in insufficient extraction of impurities from the fibers being transferred to the cylinder 4. Moreover, fiber lumps of the larger size are not opened sufficiently between the cylinder 4 and the rotating flat 5 on account of increased fiber density on the cylinder. Moreover, the product obtained from the carding machine is of inferior quality due to insufficient dust extraction from the fiber mass.

With a view to preventing the machine performance from being lowered with increase in throughput, various methods have been devised for improving the pre-opening and dust extraction of the taker-in roll 3. However, in any of these devices, the fiber lumps to be opened by the taker-in roll 2 are increased in size with increase in throughput, thus giving rise to an increased impact on the fibers which in turn causes fiber breakage and insufficient opening. It is therefore necessary to prevent fiber lumps of larger size from being conveyed through the carding machine. To this end, there are known devices in which an evener roll 8 is provided as shown in FIG. 2, or in which fixed flats 9 are provided as shown in FIG. 3. In the device provided with the evener roll as shown in FIG. 2, since the fiber lumps of larger size are returned by the evener roll 8 to the feed roll 2, these larger fiber lumps are not supplied to the working area between the cylinder 4 and the rotating flat 5. However, since the fiber lumps thus returned to the feed roll are caused to repeatedly follow the same route until they are sufficiently reduced in size, the formation of neps (lumps of tightly bound fibers) is facilitated. Moreover, seed or leaf trash or similar impurities contained in the fiber lumps of larger size are crushed into small pieces on being caused to repeatedly follow the same route, thus worsening the efficiency of dust extraction to be performed by the rotating flat 5. With the device provided with the fixed flats 9 shown in FIG. 3, fiber lumps of larger size held by the cylinder wire are combed by the fixed flats 9 for opening the lumps and separating the fibers from dust, thereby improving the efficiency of dust extraction to be performed by the rotating flat 5 and also improving the finishing opening to be performed by the rotating flat 5 through pre-opening. In addition, the wires used in the fixed flat are usually metallic wires of a specific profile which renders it difficult for the fibers to be deposited on the fixed flat. Thus the wires affixed to the fixed flats are not so effective as the carding cloth used on the rotating flat insofar as the fiber opening action is concerned. The force of impact to be afforded by the fixed flats on the fibers is not so large that fiber breakage is not caused by the fixed flats.

In the operation of the fixed flats, the fiber mass transferred from the taker-in roll 3 to the cylinder 4 is acted upon by a wire 9W of the fixed flats, while being entrained by the cylinder wire 4W, as shown in FIG. 4. (Although FIG. 4 is intended for explaining the operation and result of the present invention, it is referred to here because the prior-art device is similar to the device of the present invention insofar as the opening function of the cylinder and flat wires is concerned). Taking into consideration the tooth face angle $\alpha_1$ and the frictional coefficient of the tooth face of the cylinder wire 4W, centrifugal force of the cylinder, the tooth face angle $\alpha_2$ of the fixed flat wire 9W and the frictional coefficient of the tooth surface of the fixed flat, it will be appreciated that a centrifugal force of the rotating cylinder as well as exterior forces such as fiber opening force of the fixed flat wires (based on the speed difference between the cylinder and the fixed flats) or pneumatic force are acting on the fiber lumps held on the cylinder. Should the cylinder wires 4W fail to securely grip the fiber lumps, it is not possible to perform the pre-opening by the fixed flats or the finishing opening by the rotating flat. It is therefore desirable that, for securely holding the fibers against centrifugal force and exterior forces as mentioned above, the tooth face angle $\alpha_1$ of the cylinder wire 4W be smaller than the tooth face angle $\alpha_2$ of the fixed flat wire 9W and the fixed flat wire 9W be provided with profiled teeth lest fibers should be deposited on the wire 9W of the fixed flat. In this manner, the fiber lumps on the cylinder are opened preliminarily by fixed flat wires 9W.

SUMMARY OF THE INVENTION

It is a principal object of the present invention to provide a pre-opening device for a carding machine whereby dust contained in the fiber mass may be effectively removed therefrom in the neighborhood of the fixed flats through optimized pre-opening.

In view of such object, the present invention resides in the pre-opening device for a carding machine wherein the fibers opened by and delivered from a taker-in roll are gripped and conveyed by the wire or card clothing wound about the peripheral surface of a rotating cylinder so as to be opened through cooperation between the cylinder and the rotating flat, said pre-opening device including a plurality of fixed flats, each having a wire or card clothing on the inner wall thereof, placed in tandem in opposition to and along the peripheral wall of the cylinder intermediate the taker-in roll and the rotating flat, characterized in that a gap or opening 5 to 33 mm long circumferentially is provided between adjacent ones of the fixed flats. The fiber mass placed on the cylinder is opened by the wires of the fixed flat, in such a manner that the seed or leaf trash or similar dust contained in the fiber mass is released and separated from the fiber. The dust thus separated from the fiber mass is separated out of the operating range of the air current produced about the cylinder as a result of cylinder revolution (a cylinder induced air current) and extracted by the discharge air stream generated in the opening between each pair of fixed flats.

BRIEF DESCRIPTION OF THE DRAWINGS

The objects and advantages of this invention will become more apparent from reading the following detailed description in connection with the accompanying drawings, in which.

DESCRIPTION OF THE PREFERRED EMBODIMENTS

First of all, the basic principle of dust extraction to be performed by the present invention is hereafter described.

Figure 1:
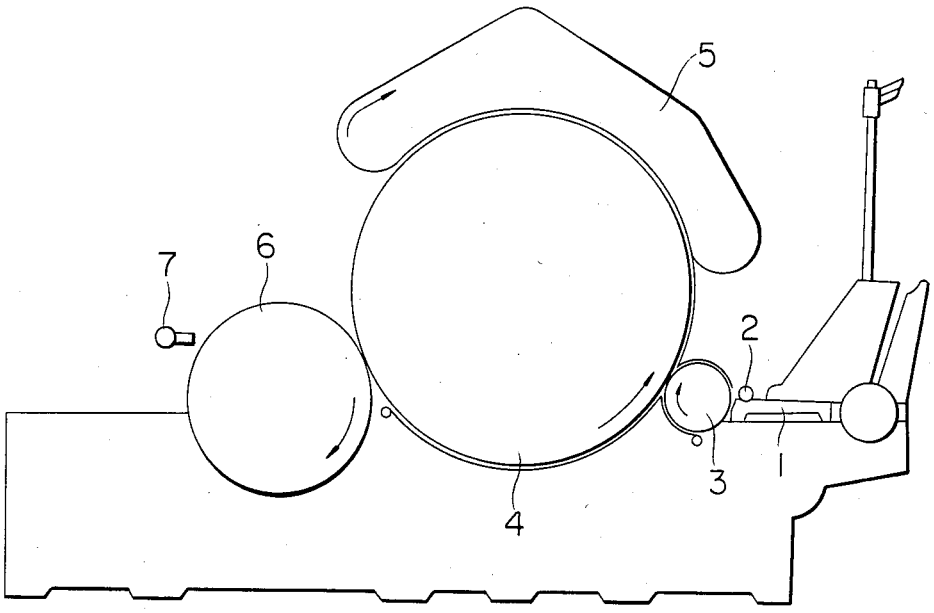
FIG. 1 PRIOR ART
FIG. 1 is a diagrammatic side view showing the conventional carding machine.
Figure 2:
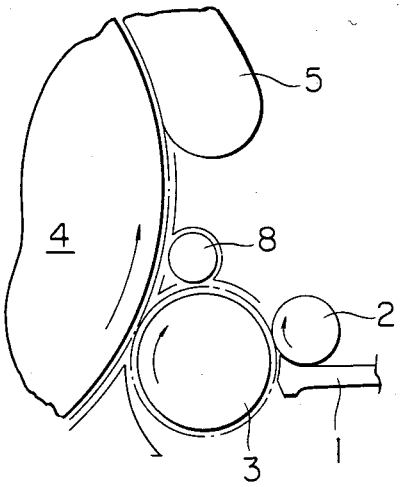
FIG. 2 PRIOR ART
FIGS. 2 and 3 are side views showing different conventional pre-opening devices.
Figure 3:
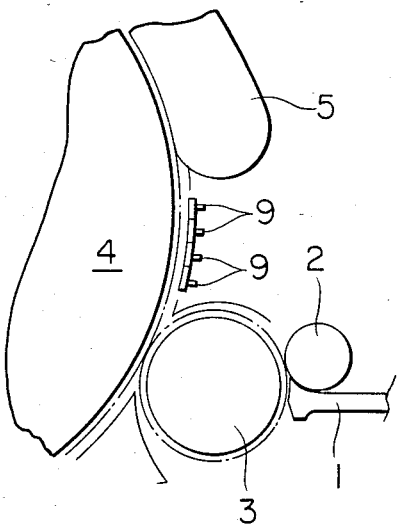
FIG. 3 PRIOR ART
Figure 4:
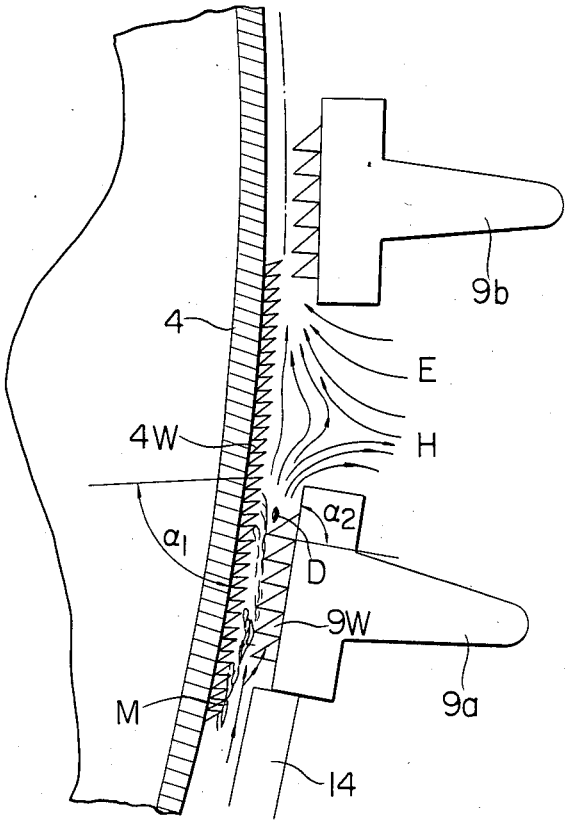
FIG. 4 is a side view showing the cylinder-induced air stream and the pre-opening performed by the wires between the fixed flats and the cylinder for explaining the operation of the present invention.

The present inventors' attention has been directed to the fact that the mode of dust distribution in the operating area between the cylinder and the fixed flats exhibits a certain probabilistic feature. Thus the pre-opening action of the cylinder and a fixed flat occurs in such a manner that a portion of a large lump of fibers caught and transported by the cylinder wire ends as shown in FIG. 4 is gripped by the fixed flat wires and opened apart based upon the relative speed between the cylinder and the flats, thereby disengaging and separating the dust contained in the fiber mass or lumps from the fibers. The dust thus disengaged is separated from the lump of fibers somewhere between the area near to the fixed flat wires and the wire roots. The dust thus disengaged and separated is caused to fly tangentially from the point of separation from the fibers and be conveyed as it gradually leaves the cylinder-induced air stream. During the time the dust is conveyed by the air current caused by cylinder revolution, the higher the terminal speed (in the state of free descent) of the dust, the more the dust is likely to leave the cylinder surface under the force of inertia and the centrifugal force acting on the dust, irrespective of the direction of the air current. The lower the terminal speed, the more the dust is likely to be affected by the air current so that it flies near to the wire points of the fixed flat which are closer to the cylinder surface. Thus the distribution of the separated dust in the area between the cylinder wire and the fixed flat wires is such that the dust of smaller size (with lower terminal speed) is caused to fly near to the tooth or wire ends of the fixed flat, while the dust of larger size is caused to fly near to the tooth or wire roots.

On the basis of the above finding, the present invention provides an arrangement in which a gap or opening of predetermined circumferential extent is formed between each pair of adjacent fixed flats and an air current generated at the upstream side in the rotational direction of the cylinder is caused to be deflected from the cylinder through said gap along with entrained dust. In the conventional pre-opening device comprised of fixed flats, no gap is provided between adjacent fixed flats, or the gap, if any, is so small in size that the discharge air current is not formed successfully or the large size dust flowing near to the wire ends of the fixed flats (by) being entrained in the slowly moving cylinder-induced air (current) is unable to pass through such narrow gap to be discharged to the outside. According to the present invention, there is provided an opening or gap of a sufficient length to cause the dust of larger size to be entrained in the air current and be discharged away from the cylinder.

Turning now to the air current generated in the opening or gap between adjacent flats, when an opening is provided at a location around the cylinder, the environmental air around the cylinder is influenced by the cylinder-induced air current so that it is dragged at one time into the cylinder-induced air current or the latter is caused to flow out to the outside of the cylinder at another. Such discharge and suction air currents are similarly generated in the gap or opening between each pair of adjacent fixed flats. The cylinder-induced air stream is flowing very fast and in a compressed state in the space near to the cylinder back sheet 14 just ahead of the fixed flat *9a*, because the spacing between the cylinder wire points and the inner surface of the back sheet is narrow and usually of the order of 0.4 to 0.5 mm. In the area of the fixed flat *9a* just back of the back sheet 14, the spacing between the cylinder wire points and the flat wire points is narrow and of the order of 0.3 to 0.5 mm, and a large spacing exists between the fixed flat wire points and roots. The result is that the compressed cylinder-induced air current emanating from the back sheet 14 is expanded between the cylinder and the fixed flat. Moreover, since the downstream side of the fixed flat *9a* communicates with the atmosphere, there is induced a current H flowing into the environmental atmosphere along the downstream end face of the fixed flat *9a*. On the other hand, at the downstream side of the gap defined between adjoining fixed flats, that is, at the upstream side of the fixed flat *9b* in FIG.

4 which is also disposed downstream with respect to the direction of flow of the cylinder-induced air current, the surrounding air is dragged by the cylinder-induced air current, thus inducing a suction air current E in the surrounding atmosphere. These discharge and suction air currents H, E are indicated schematically by the solid flow lines in FIG. 4. Referring to FIG. 4, and considering the cylinder-induced air current flowing through the space between the cylinder and the fixed flat, only an air current portion flowing near to the fixed flat wire roots flows out as discharge air current, in such a manner that the suction air current E accounts for about 70 to 80 percent and the discharge air current H accounts for about 20 to 30 percent of the total area defined between the adjacent fixed flats. The above applies to any gap defined between adjoining fixed flats. Since the flow rates of the discharge and suction air currents remain approximately equal to each other, the suction air current E is generally slow, whereas the discharge current H flows out through the narrow area at a faster rate than the entry of the suction current E. When the pre-opening is carried out between the cylinder wire and the fixed flat in the presence of these discharge and suction air currents, a piece D of dust separated from the fiber mass on the cylinder is caused to progressively fly away from the cylinder surface under its own inertial force and the centrifugal force acting on the dust D, in such manner that the dust of larger size tends to be collected onto the wire roots of the fixed flat, and the dust of smaller size flows near to the wire points of the fixed flat. Hence the dust of larger size flying near to the wire roots of the fixed flat is entrained in the discharge current H and is discharged to the atmosphere. On the other hand, the dust flying near to the wire points of the fixed flat is not influenced by the air current H being discharged to the atmosphere outside. Thus it is not discharged but is entrained and conveyed by the cylinder-induced air current. As regards the dust flying through an area between the wire points and roots of the fixed flat, a part of such dust is entrained by the discharge air current and discharged to the outside. However, such dust is entrained in the suction air current E and recovered to the cylinder to be conveyed further by the cylinder-induced air current. The last-mentioned dust is not extracted at the first gap, however, and it may be ultimately extracted by providing several fixed flats and associated gaps of predetermined length just back of the respective fixed flats. Thus the small-size dust separated from the fiber mass on the cylinder and flying past the wire roots of the fixed flat is entrained in the high speed cylinder-induced air current and is not likely to be detached immediately from the cylinder surface. However, such dust is detached gradually from the cylinder surface under an inertial force until finally the dust is detached from the cylinder surface at the opening just back of the second or third fixed flat to the extent that it is well within the working range of the discharge current. Thus the dust is entrained by said current and discharged. For achieving such function, it is required that the spacing between adjoining fixed flats be selected appropriately.

Since the extraction of large sized dust is primarily intended in the present invention, the aforementioned spacing need be broad enough to permit extraction of such large dust. Considering that dust of more than about 1.5 mm diameter need be extracted, that the dust is entrained in the discharge air current to be thereby discharged to outside, and that the area occupied by the discharge air current accounts for about 30 percent of the total area between the adjacent fixed flats, it is preferred that the extent of the opening defined between adjacent fixed flats be larger than $$1.5 \times \frac{10}{3} \approx 5 \text{ mm}.$$

The broader the spacing, the more beneficial is the result insofar as dust extraction is concerned. When the opening is too broad, it may be feared that fiber components are extracted simultaneously, with the rate of long fibers in such extracted fiber components increasing progressively with an increase in the opening distance. That is, when the fiber mass gripped by the cylinder wire is opened by the fixed flat wire, dust contained in the mass is separated from the fibers, while floating fibers not gripped by the cylinder wire are also produced simultaneously. These floating fibers are essentially useless short fibers. However, when a spacing is provided between fixed flats, the fiber mass on the cylinder is floated over the cylinder surface under the action of centrifugal force, in such manner that a part of the fibers of the mass is detached from the cylinder surface and acts as floating fiber. Thus the rate of useful long fibers in the floating fibers is increased. These floating fibers have their own inertial force, although smaller than that of dust, and are acted upon by the cylinder-induced air current, similarly to the dust mentioned above. The terminal speed of the fibers is extremely low as compared to that of dust so that the fibers are more likely to be influenced by the cylinder-induced air current, and the chance that the floating fibers will be extracted to the outside is low. However, it is highly probable that a minor amount of the useful long fibers will be entrained by the discharge current and thereby discharged to the outside. In order to prevent such extraction of the useful long fibers, it is not possible to use too broad a spacing between the adjacent fixed flats. Considering the dust size distribution, the mass of fibers transferred from the taker-in roll 3 to the cylinder 4 is opened in advance by the taker-in roll so that the dust with extremely large size has been extracted. Therefore, a great majority of the dust separated from the fiber mass by the pre-opening action of the cylinder and fixed flat wires is composed of dust particles which are less than 5 mm diameter, with some of the dust being 5 to 10 mm diameter, assuming the dust to be spherical in shape. Considering this fact in setting the upper limit of the spacing of the opening between the adjoining flats, the extent of the spacing to be reserved for the discharge current equal to 10 mm at the maximum is sufficient and, since the extent of the spacing to be reserved for the discharge air current is about 30 percent of the spacing between the adjacent fixed flats, the upper limit of the spacing between the fixed flats is $$10 \times \frac{10}{3} \approx 33 \text{ mm}.$$

It is seen from above that the present invention provides an arrangement in which a plurality of fixed flats is mounted in juxtaposition and the adjoining ones of the fixed flats are spaced apart from each other for providing an opening of 5 to 33 mm width, in such a manner that the dust is entrained in the discharge current generated at the upstream side of the opening for thereby discharging the dust to the outside.

In the description below, several modes of practicing the invention are given only by way of examples.

According to a first aspect of the present invention, the downstream side inner wall surface of the fixed flat in the rotational direction of the cylinder flat is increasingly spaced apart from the cylinder wall surface in such a manner that a discharge air stream is produced and caused to flow along the downstream side inner wall surface of the fixed flat and in a direction away from the cylinder surface for effectively producing the discharge air stream in the opening.

The opening device according to the first aspect of the invention has an advantage that the discharge air current flowing along the inner wall end face and increasingly apart from the cylinder surface is produced and the fibers released and separated from the fibers upon opening by the combined action of the cylinder and the fixed flat is entrained in the discharge stream and thereby discharged efficiently.

According to the first aspect, the downstream side inner wall end face may be streamlined, arcuate or in the form of an angled flat surface. Alternatively, a separate member having such streamlined arcuate or flat profile may be securely annexed to the downstream end of the fixed flat.

According to a second aspect of the invention, a partition element is placed at a boundary zone between the upstream side discharge air current and the downstream side suction air current, with said partition element lying closer to the wall surface of the cylinder than to the inner wall surface of the fixed flat, thereby effectively dividing the discharge and suction air currents from each other. Thus the dust may be entrained in the discharge air current effectively defined by the partition element and may thereby be discharged efficiently.

The opening device of the second aspect may be combined with the device of the first aspect in such a manner that the downstream side inner wall end face of the fixed flat and the upstream side wall surface of the partition member are configured to suit the flow lines of the discharge air currents at the upstream side of the opening, thereby producing a more efficient and stable discharge air current and elevating dust extraction efficiency.

According to a further aspect of the present invention, the upstream side inner wall end face of the fixed flat and the downstream side wall surface of the partition element are configured to suit the flow lines of the suction air stream produced at the downstream side of the opening, thus efficiently and stably forming the suction air current towards the cylinder and the fixed flat and providing a more intensified and stable discharge air current at the upstream side of the next opening.

Referring to the drawings, there are shown certain preferred embodiments of the pre-opening device of the present invention.

Figure 5:
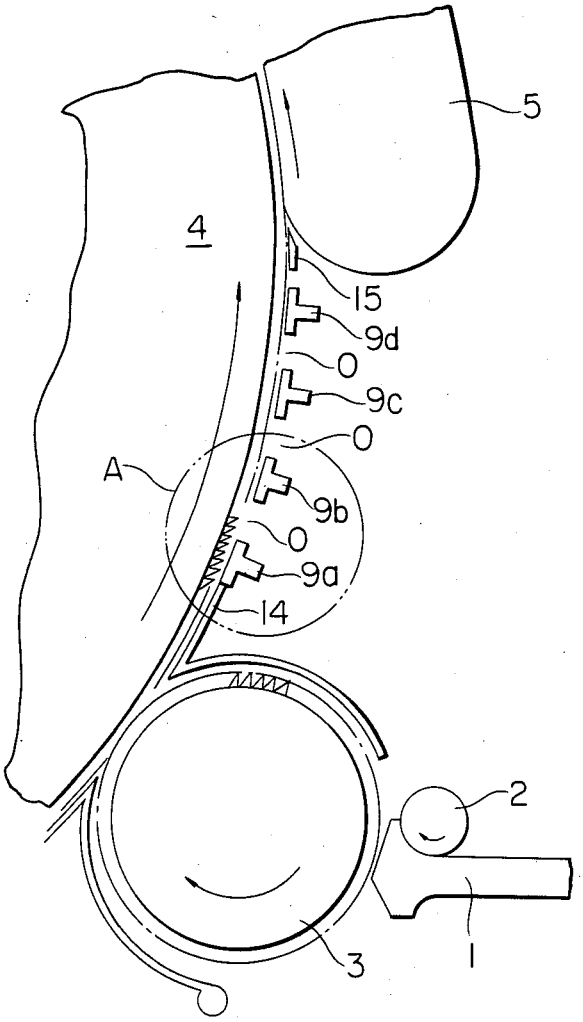
FIG. 5 is a side view showing an opening device according to a first embodiment of the present invention.
Figure 6:
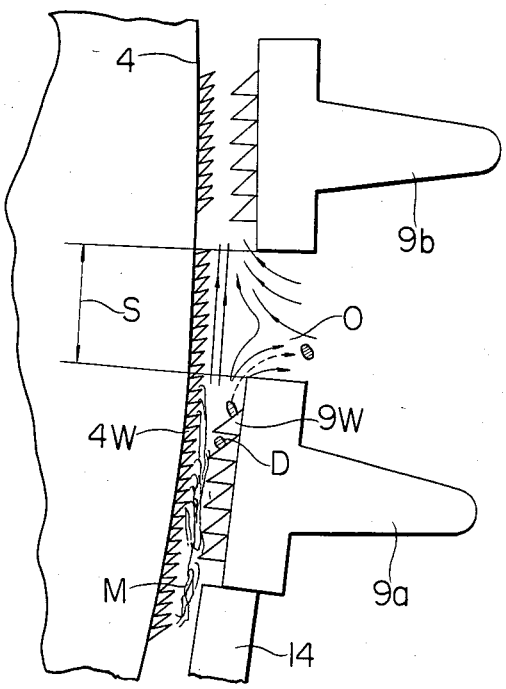
FIG. 6 is an enlarged view of a portion surrounded by a circle A in FIG. 5.

FIGS. 5 and 6 illustrate a pre-opening device for the carding machine according to a first embodiment of the present invention. In a carding machine comprised of dish plate 1, feed roll 2, taker-in roll 3, cylinder 4 and the rotating flat 5, as shown in FIG. 5, a cylinder back sheet 14, four fixed flats 9*a*, 9*b*, 9*c* and 9*d* and a cylinder back sheet 15 are provided along the cylinder surface between the taker-in roll 3 and the rotating flat 5, while an opening O of 20 mm long is provided in the space S between adjoining ones of the fixed flats and throughout the width of the cylinder 4. FIG. 6 shows an encircled portion A to a larger scale.

The operation of the present first embodiment is hereafter described. The fiber used in the present embodiment is the raw cotton fiber for 20-count yarn. A lap, not shown, is supplied to the feed roll 2 and held between the dish plate 1 and the feed roll 2 by the rotation of the feed roll 2 so as to be supplied to the taker-in roll 3. Since the taker-in roll 3 is wound with metallic wires and rotating at a markedly higher speed (13 m/sec) than the feed roll 2, the lap is separated into fiber lumps M which then are opened and conveyed to the cylinder 4. Since the cylinder 4 is wound with metallic wires as is the taker-in roll, and rotated at a higher speed (20 m/sec) than the taker-in roll 3, the fibers are caught by the wires of the cylinder 4 and thereby conveyed through back sheet 14 and through fixed flats 9*a*, 9*b*, 9*c*, and 9*d* in this order. When the fiber lumps are conveyed through the first fixed flat 9*a*, one lump M of such lumps which is larger in size and closer to the fixed flat beyond the gap between the tooth ends of the cylinder wire 4W and the tooth or wire points of the fixed flat 9*a*, is caught by the tooth or wire points of the fixed flat wire to be thereby opened so that seed or leaf trash or similar dust contained in the fiber lump M are separated. A portion of the thus separated dust is entrained in the discharge air stream to be finally discharged to the outside. The dust heaped on the inner wall surface of the fixed flat is conveyed along the wall surface to be discharged via opening O. In the present embodiment in which the openings O with a predetermined circumferential length of 20 mm are provided back of the four fixed flats, the sum of the amount of dust that may be extracted below the taker-in roll and the amount of dust that may be extracted back of the fixed flats is larger than the amount that may be extracted in the conventional device below the taker-in roll, while the rate of dust extraction is not lowered with increase in throughput, in contrast to the conventional device in which the rate of dust extraction collected below the taker-in roll is lowered upon increase in throughput from 20 kg/hour to 50 kg/hour. In addition, in the present first embodiment, the number of neps (fibers bonded together) in the sliver (filament bundle obtained from the carding machine) and the number of blocks of intertwined fibers are generally fewer than those encountered with the conventional device, although only slightly, which accounts for improved pre-opening action achievable with the present embodiment.

In short, the cylinder-induced air stream is exposed to atmosphere through the openings O just back of the fixed flats. This and the action of the centrifugal force produced upon cylinder revolution are effective to cause the fiber lumps to be floated above the cylinder surface. Since the fibers thus floated are acted upon immediately by the fixed flat wires, the innermost portion of the fiber lump undergoes the fiber opening action thus effectively improving the fiber pre-opening.

Figure 7:
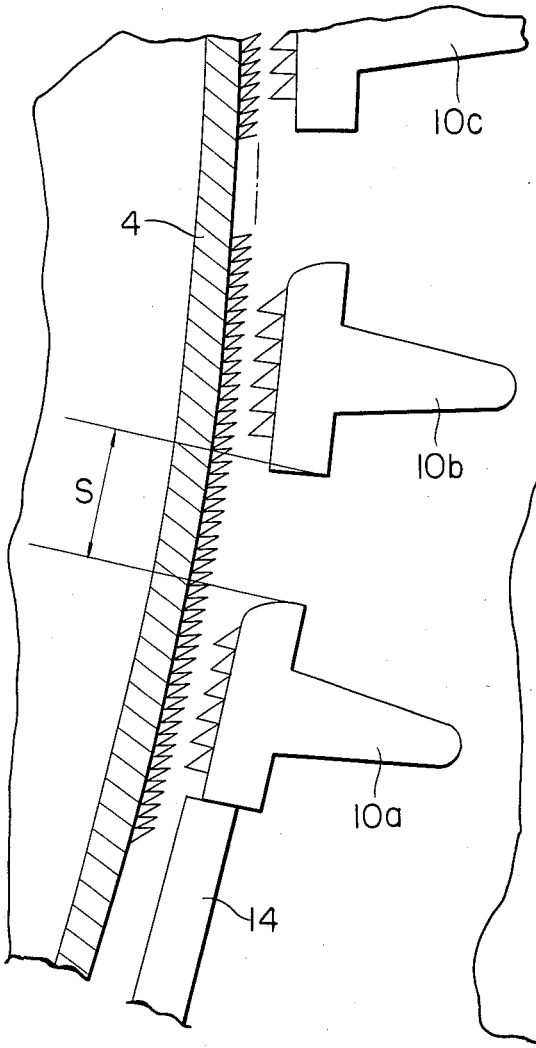
FIG. 7 is a side view showing a second embodiment of the present invention.
Figure 8:
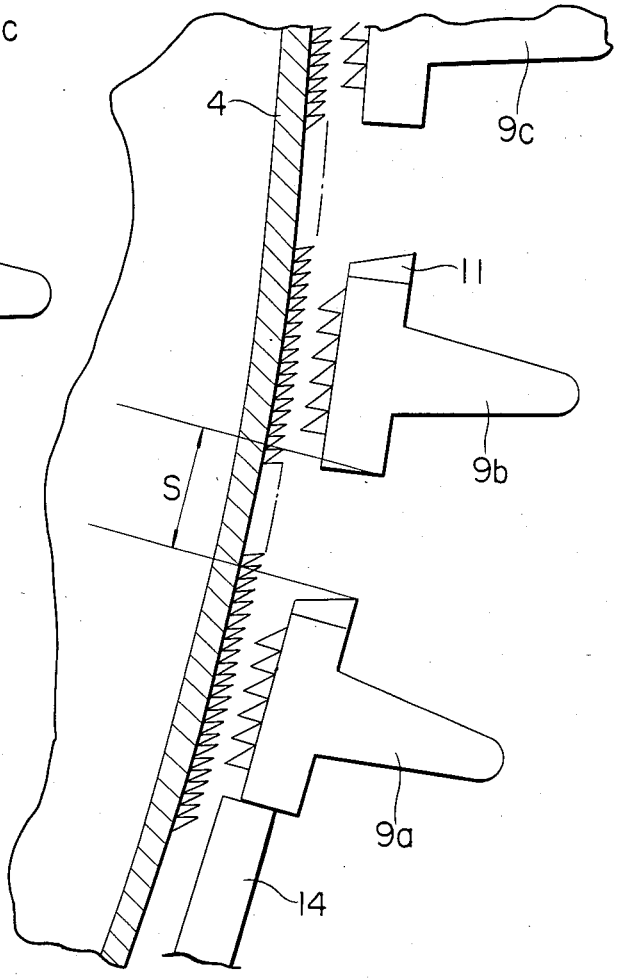
FIG. 8 is a side view showing a modification of the second embodiment.

The device of the second embodiment belongs to the first aspect of the invention and has four fixed flats with a spacing of 20 mm between adjoining flats similarly to the first embodiment shown in FIG. 5. The downstream side inner wall end face of each of the fixed flats 10*a*, 10*b*, 10*c*, 10*d* are streamlined as shown in FIG. 7 with the exception of the flat 10*d*, in such a manner that the downstream side ends of the flats are spaced further away from the cylinder wall so as to permit smooth exit of the discharged air stream. According to this second embodiment, that portion of the cylinder-induced air current which is discharged to the outside is more stable and increased in flow, resulting in an elevated rate of dust extraction. The downstream side of the fixed flat may be of two-piece construction as shown in FIG. 8, in which a separate member 11 having an angled straight end face is attached by screws, not shown, to the end face of the flat such that the end face of the member 11 extends further away from the cylinder surface towards the downstream side of the flat. The operation and result of the second embodiment is similar to the above described first embodiment.

Figure 9:
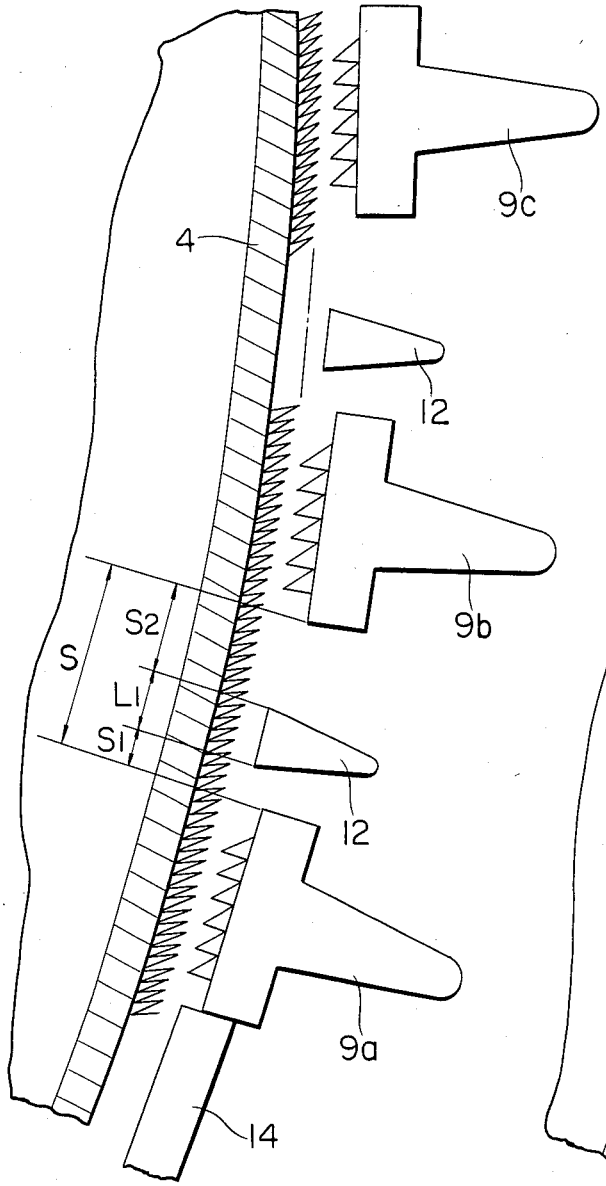
FIG. 9 is a side view showing a third embodiment of the present invention.

The device of the third embodiment belongs to the second aspect of the invention. In the present embodiment, the four fixed flats are positioned with openings 30 mm long disposed intermediate the neighboring flats (S in FIG. 9 equals 30 mm), and a grid bar 12 acting as partition element is mounted in each said opening. The grid bar 12 has a width $L_1$ of the bottom surface thereof confronting to the cylinder equal to 10 mm, a spacing $S_1$ equal to 6 mm, and a spacing $S_2$ equal to 14 mm. The grid bar 12 is so placed that the bottom surface thereof lies intermediate the pointed ends and the roots of the flats. Dust extraction rate can be changed by using various size grid bars for changing the width $L_1$ of the grid bottom and the distance between the cylinder wire points and the grid bottom. According to the present third embodiment, a discharge air stream is defined along the upstream side wall surface of the grid bar so that that portion of the cylinder-induced air current which is discharged to the outside may be increased and the route of the discharge air current may be completely isolated from that of the suction air current, in such a manner that the dust entrained by the discharge air current is not sucked into the suction air current and again introduced towards the cylinder. According to this third embodiment, the effect of dust extraction may be improved as in the second embodiment.

Figure 10:
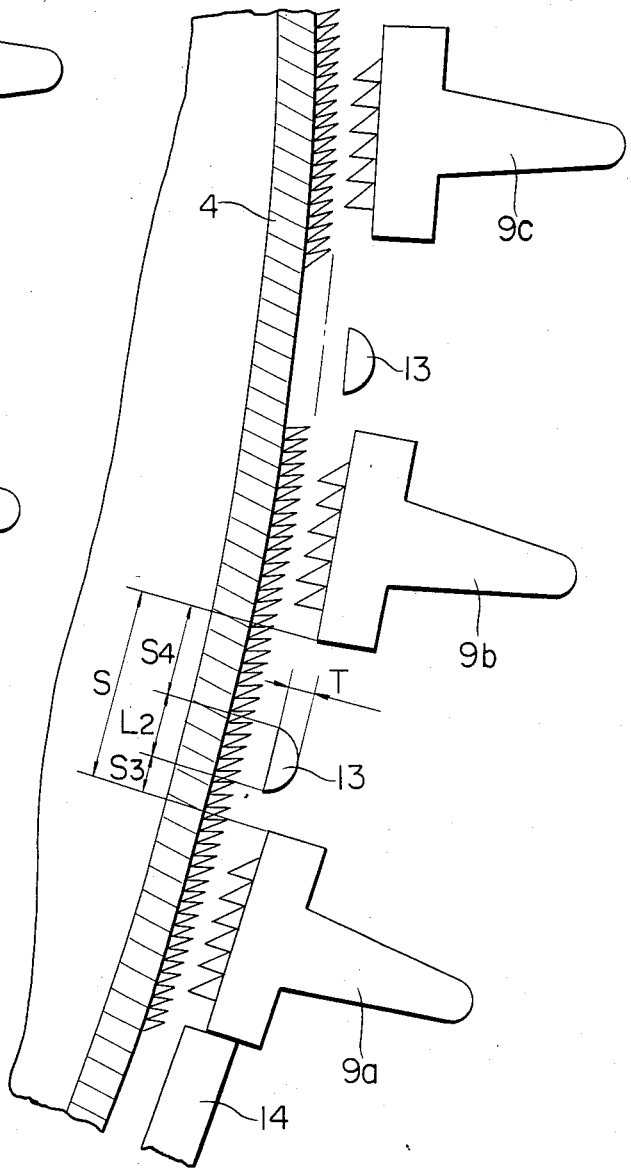
FIG. 10 is a side view showing a fourth embodiment of the present invention.

The device of the fourth embodiment belongs to the second aspect of the invention. As shown in FIG. 10, four fixed flats are placed at intervals of 30 mm and plate-like members 13 having an arcuate exterior surface are disposed in the openings defined between adjacent flats. The plate-like member 13 has a width $L_2$ equal to 10 mm, an interval $S_3$ equal to 6 mm and an interval $S_4$ equal to 14 mm. The side of the plate-like member 13 facing towards the cylinder is positioned intermediate the pointed ends and roots of the fixed flat. Dust extraction rate can be changed by using various size plate-like members 13 for changing the width $L_2$ and thickness T, the distance between the cylinder wire points and the member 13, and the interval $S_3$, $S_4$. According to this third embodiment, that portion of the cylinder-induced air current, which is discharged to the outside, may be increased and, by provision of the plate-like member 13 in the boundary between the discharge and suction air currents, the dust once discharged to the outside with the discharge air current is not recovered with the suction air current, whereas the floating fiber once discharged to the outside with the discharge air current is again recovered with the suction air current. Dust extraction and recovery of floating fibers may be achieved on account of the marked difference between the ultimate speed of the dust and that of the fibers. According to the present embodiment, dust extraction can be achieved efficiently with prevention of extraction of the useful long fibers. The recovery rate of floating fibers can be changed by changing the width $L_2$ and thickness T as well as mounting conditions of the plate-like member 13.

The second embodiment of the present invention can also be combined with the third or fourth embodiments with beneficial results, although such combination is not shown in the drawing for simplicity.

It is seen from above that the present invention provides for extracting dust such as seed or leaf trash from the fiber mass held on the cylinder wires by virtue of the fiber pre-opening function of the fixed flat, with the thus separated dust being then entrained in the discharge air current and discharged efficiently to the outside through the opening arranged just back of the fixed flat. In addition to dust extraction, the opening provided just ahead of the fixed flat is effective to cause the fiber mass to be floated over the cylinder surface under centrifugal force as described above so that the fixed flat disposed just back of the opening may act on the innermost layer of the fiber mass for improving the pre-opening. The result is that the metallic wire on the cylinder is not stopped up with dust thus dispensing with frequent wire cleaning. In addition, the useful service life of the wire may be prolonged and the performance of the carding machine may be maintained for long periods due to the reduced load on the carding cloth wires of the rotating flat and the cylinder wire brought about by the improved dust extraction and pre-opening.

Although the present invention has been made solely on the basis of the main probabilistic phenomenon, it is to be noted that some of the dust contained in the fiber mass such as seed or leaf trash is released and separated from the fibers under opening action of the cylinder and the fixed flat, then discharged tangentially under the centrifugal force through the opening towards the wall of the next fixed flat from where it is discharged finally to the outside.

What is claimed is:

1. Pre-opening device for a carding machine, wherein the fibers opened by and delivered from a taker-in roll are gripped and conveyed by the wire wound around the peripheral wall of a rotating cylinder so as to be opened through cooperation between the cylinder and a rotating flat, said pre-opening device including a plurality of fixed flats, each having a wire on the inner wall thereof, placed in tandem in opposition to and along the peripheral wall of the cylinder intermediate the taker-in roll and the rotating flat, characterized in that an opening 5 to 33 mm long circumferentially is provided between respectively adjacent ones of the fixed flats.

2. The device as claimed in claim 1, characterized in that the downstream side inner wall surface of each said fixed flat in the rotational direction of the cylinder is increasingly spaced apart from the cylinder wall surface.

3. The device as claimed in claim 2, characterized in that the inner wall end face of each said fixed flat in the rotational direction of the cylinder is formed as a separate member from the main body of the fixed flat.

4. The device as claimed in claim 1, characterized in that a partition member is placed at a boundary between the upstream side discharge air current and the downstream side suction air current induced between each adjacent pair of said fixed flats in the rotational direction of the cylinder, with the inner wall surface of the partition element lying closer to the wall surface of the cylinder than to the inner wall surface of an adjacent fixed flat.

5. The device as claimed in claim 4, characterized in that the outer wall surface of each partition element is arcuate.

6. The device as claimed in claim 4, characterized in that the respective of said partition elements are of different size and are interchangeable with each other.

7. The device as claimed in claim 4, characterized in that the downstream side outer wall surface of each partition element is increasingly spaced apart from the cylinder.

8. The device as claimed in claim 4, characterized in that the upstream side inner wall end face of each fixed flat and the downstream side end wall face of its associated partition element are substantially configured to follow the streamline of the said suction air current flowing between the partition element and the fixed flat.

9. The device as claimed in claim 1, characterized in that the downstream side inner wall surface of the fixed flat in the rotational direction of the cylinder is increasingly spaced apart from the cylinder wall surface, and in that a partition member is placed at the boundary between the upstream side discharge air current and the downstream side suction air current induced between each adjacent pair of said fixed flats in the rotational direction of the cylinder, with the inner wall surface of the partition element lying closer to the wall surface of the cylinder than to the inner wall surface of an adjacent fixed flat.

* * * * *